US010448148B1

(12) United States Patent
Combest et al.

(10) Patent No.: US 10,448,148 B1
(45) Date of Patent: Oct. 15, 2019

(54) HANGING SPEAKER SYSTEM

(71) Applicant: MS ELECTRONICS LLC, Overland Park, KS (US)

(72) Inventors: Christopher E. Combest, Leawood, KS (US); Lindsey K. Humphrey, Kansas City, MO (US); Kenneth Hecht, Jacksonville, FL (US)

(73) Assignee: MS Electronics, LLC, Overland Park, KS (US)

( * ) Notice: Subject to any disclaimer, the term of this patent is extended or adjusted under 35 U.S.C. 154(b) by 0 days.

(21) Appl. No.: 16/394,708

(22) Filed: Apr. 25, 2019

Related U.S. Application Data

(63) Continuation-in-part of application No. 16/244,268, filed on Jan. 10, 2019.

(51) Int. Cl.
*H04R 1/00* (2006.01)
*H04R 1/28* (2006.01)

(52) U.S. Cl.
CPC ..... *H04R 1/2803* (2013.01); *H04R 2201/021* (2013.01)

(58) Field of Classification Search
CPC ..... H04R 1/28; H04R 1/2803; H04R 1/2823; H04R 1/2826; H04R 1/2846; H04R 1/2857; H04R 1/2896; H04R 1/24; H04R 2201/021
See application file for complete search history.

(56) References Cited

U.S. PATENT DOCUMENTS 4,348,549 A * 9/1982 Berlant ..... H04R 1/26 181/152
5,189,706 A * 2/1993 Saeki ..... H04R 1/2826 181/155
5,721,401 A * 2/1998 Sim ..... H04R 1/345 181/148
5,995,634 A * 11/1999 Zwolski ..... H04R 1/028 181/155
6,144,751 A * 11/2000 Velandia ..... H04R 1/2826 181/153
6,597,797 B1 * 7/2003 Betts ..... H04R 1/345 181/155

(Continued)

*Primary Examiner* — Matthew A Eason
(74) *Attorney, Agent, or Firm* — Hovey Williams LLP

(57) ABSTRACT

A speaker system broadly comprises a plurality of speaker assemblies each including a speaker housing, an input circuit, a low range speaker, and a higher-range speaker. The input circuit receives audio signals from a sound system or other controller and actively or passively sends the audio signals to the speakers. The low-range speaker is positioned in the upper section and the higher-range speaker is positioned in the lower section. Each speaker assembly is configured to be suspended from an elevated structure and spaced from the other speaker assemblies within a listening area with each speaker assembly generating low frequency soundwaves and higher-frequency soundwaves. This reduces or eliminates out-of-phase crossover frequency wave cancellation effects within the listening area. The speaker housings are compact while allowing the low-range speaker and higher-range speaker to effectively produce and project desired soundwaves from the suspended speaker housing into the listening area.

20 Claims, 8 Drawing Sheets

(56) References Cited

U.S. PATENT DOCUMENTS

| | | | | |
|---|---|---|---|---|
| 6,604,602 | B1 * | 8/2003 | Kim | H04R 1/2842 181/189 |
| 7,606,379 | B2 * | 10/2009 | Ivey | F21V 7/0008 381/160 |
| 8,098,852 | B2 * | 1/2012 | Harwood | H04R 5/02 181/153 |
| 8,275,164 | B1 * | 9/2012 | Nguyen | H04R 1/2857 381/337 |
| 8,442,242 | B2 * | 5/2013 | Harwood | G10K 11/28 181/176 |
| 2016/0227315 | A1 * | 8/2016 | Kim | H04R 1/2819 |
| 2016/0337748 | A1 * | 11/2016 | Goksel | H04R 1/2896 |
| 2017/0006376 | A1 * | 1/2017 | Tan | H04R 1/20 |
| 2017/0094403 | A1 * | 3/2017 | Tipparaju | H04R 1/288 |

* cited by examiner

HANGING SPEAKER SYSTEM

RELATED APPLICATIONS

This patent application is a continuation-in-part (CIP), and claims priority benefit with regard to all common subject matter, of earlier-filed non-provisional U.S. patent application Ser. No. 16/244,268, filed on Jan. 10, 2019, and entitled "HANGING SPEAKER SYSTEM". The identified earlier-filed non-provisional patent application is hereby incorporated by reference in its entirety into the present application.

BACKGROUND

Speakers are often used in shopping areas, atriums, foyers, pavilions, and other at least partially enclosed areas for reproducing music, talk radio, and other audio. Conventional speaker systems often include a low-range speaker such as a subwoofer and a number of higher-range speakers spaced from the low-range speaker. The frequency ranges of the low-range speaker and the higher-range speakers often overlap, with crossover frequency soundwaves being generated by both the low range speaker and the higher-range speakers. When the speakers are spaced apart, the crossover frequency soundwaves are often out of phase with each other in portions of the listening area, thus resulting in unwanted wave cancellation or muting effects.

Such speakers are often positioned on floors, placed on countertops, tables or other furniture, or mounted to walls. This can displace other fixtures or furniture, distract from the intended ambience of the listening area, and/or result in suboptimal acoustics.

SUMMARY

Embodiments of the invention solve the above-mentioned problems and provide a distinct advance in the art of speaker assemblies and speaker systems. More particularly, the invention provides a hanging speaker system broadly comprising a number of speaker assemblies configured to be hung from a ceiling or other elevated structure to form a listening area. Each speaker assembly generates low frequency soundwaves and higher frequency soundwaves while reducing or eliminating out-of-phase crossover frequency wave cancellation effects when spaced from the other speaker assemblies within the listening area.

Each speaker assembly of the speaker system broadly comprises a speaker housing, a hanging component, an input circuit, a low range speaker, and a higher-range speaker. The speaker housing broadly comprises an upper section and a lower section. The speaker housing may be substantially cylindrical or any other suitable shape and narrow for allowing the speaker assembly to be less conspicuous and positioned in narrow spaces.

The upper section encloses the low range speaker and broadly comprises an outer wall and a divider. The outer wall defines an upper chamber and a lower chamber. A lower end of the outer wall may be flared radially outward slightly, the purpose of which will be described below. The upper section may be formed of PVC or other plastic, metal, or any other suitable material and may be waterproof and/or corrosion resistant.

The upper section also includes a connector for securing the speaker housing to the hanging component. The connector is positioned near a middle of the top of the upper section so that the speaker assembly is balanced and oriented vertically upright when hanging from the ceiling. Alternatively, the connector may have three or more mounting points along a top periphery of the speaker housing.

The upper chamber retains the low-range speaker therein and is acoustically shaped for projecting low frequency soundwaves generated by the low-range speaker down to the lower chamber. The upper chamber may also have any suitable size for optimizing the projection of low frequency soundwaves therefrom.

The lower chamber encircles at least a portion of the lower section and allows low frequency soundwaves generated by the low range speaker to pass out of a lower port exit of the speaker housing via a lower port channel. The lower chamber is acoustically shaped and may have any suitable size for optimizing the projection of low frequency soundwaves generated by the low range speaker downwards through the lower port channel and outwards through the lower port exit.

The divider extends horizontally in the upper section and partitions the upper section into the upper chamber and the lower chamber. The divider also supports the low-range speaker such that the low-range speaker is spaced from a top of the upper section.

The lower section encloses the higher-range speaker and broadly comprises an outer wall, a baffle, and a plurality of vanes. The outer wall includes an upper portion and a lower portion and forms an inner chamber. The lower section and the outer wall cooperatively form the lower port exit.

The upper portion extends upwards into the lower chamber of the upper section and thus has a smaller outer diameter than an inner diameter of the outer wall. The upper portion also has a smaller outer diameter than an outer diameter of the lower portion. The upper portion extends upwards a selected vertical length into the lower chamber so as to effect a desired length of the lower port channel. This optimizes low frequency output. If a cross section area of the lower port channel and/or the lower port exit is increased, the length of the lower port channel should be increased for a given tuning. Likewise, if the cross section area of the lower port channel and/or the lower port exit is decreased, the length of the lower port channel should be decreased. Meanwhile, decreasing the cross section area of the lower port exit increases air velocity therethrough, which may cause port noise. Thus, the lower end of the outer wall of the upper section near the lower port exit may be flared radially outward slightly so as to increase the cross section area of the lower port exit and thereby reduce port noise. A longer flare may provide more port noise mitigation.

The lower portion has a larger diameter than the upper portion and has an outer diameter substantially equal to the outer diameter of the outer wall. As such, the lower portion and the outer wall of the upper section appear essentially as vertical extensions of each other separated by the lower port exit.

The inner chamber encloses the higher range speaker therein and is acoustically shaped for projecting higher-frequency soundwaves. The inner chamber may have any suitable size for optimizing the projection of higher-frequency soundwaves.

The baffle encloses the inner chamber of the lower section and extends radially beyond the lower portion. The baffle concentrates higher frequency soundwaves below the speaker assembly. The baffle may be sized to optimize directivity and amplitude of the higher frequency soundwaves. The baffle may be a cover, a plate, or any other suitable enclosing structure.

The vanes extend radially outward from the upper portion of the outer wall of the lower section to the outer wall of the upper section so as to connect the lower section to the upper section. The vanes also divide the lower port channel into a plurality of radial spaces. The radial spaces are vertically extending pathways through which low frequency soundwaves from the low-range speaker may pass from the lower chamber to the lower port exit.

The hanging component suspends the speaker assembly from a ceiling or other elevated structure and is secured to an anchor or other mounting feature of the ceiling near its upper end and is secured to the connector at its lower end. The hanging component may support or house electrical or electronic wiring connected between the input circuit and a sound system and/or a power source. The hanging component may be a cable, a chain, a wire, a rope, a rigid member, or any other suitable structure.

The input circuit receives audio signals from the sound system and actively or passively sends the audio signals to the speakers. The input circuit may include an antenna, data bus, data port, or any other suitable communication component, an amplifier, a mixer, or any other suitable sound manipulation component. The input circuit may be connected directly to the low range speaker and/or higher-range speaker or through a passive crossover. The input circuit may be positioned in the upper section, the lower section, or any other location for improving signal reception.

The low range speaker generates low frequency soundwaves and is positioned in or mounted to the divider and aimed upwards or downwards for projecting the low frequency soundwaves through the lower port channel (via the radial spaces) and out the lower port exit. The low range speaker may be a woofer, subwoofer, bass speaker, or other low-range speaker.

The higher-range speaker generates higher frequency soundwaves and is positioned in or mounted to the baffle. The higher-range speaker is aimed downwards for projecting higher frequencies. The higher-range speaker may be a full range speaker, a woofer with a tweeter, a woofer with a midrange and tweeter, or any other similar speaker or combination of speakers.

The speaker assembly provides several advantages. For example, the speaker assembly is spaced apart from other speaker assemblies throughout the listening area such that low frequency soundwaves and higher frequency soundwaves can be received from at least one of the speaker assemblies for most and/or key regions of the listening area. In this way, soundwaves of a particular crossover frequency from a low-range speaker located at a given position and soundwaves of the same crossover frequency from a higher-range speaker located at the same position will not form acoustically muted regions.

The speaker assembly is suspended from the ceiling or another elevated structure via the hanging element for providing audio to the listening area. This also allows the speaker assembly to be concealed or positioned so as to not draw attention thereto. The cylindrical shape of the speaker housing further diverts attention from the speaker assembly.

The upper portion of the lower section may extend upwards a selected vertical length so as to effect a desired length of the lower port channel. This may allow acoustics of the low frequency soundwaves to have a desired effect and may reduce port noise.

Another embodiment is a hanging speaker assembly broadly comprising a speaker housing, an input circuit, a low range speaker, and a higher range speaker. The speaker housing broadly comprises an upper section and a lower section for protecting the input circuit and speakers from the surrounding environment.

The upper section includes an outer shell and a plurality of ribs. The outer shell covers a top end of the lower section and encircles an upper portion of the lower section. The outer shell is vertically spaced from the top end of the lower section so as to form an upper chamber and is radially spaced from the lower section so as to form an open-ended circumferential slot.

The upper chamber redirects soundwaves from the low range speaker outward to the open-ended circumferential slot via openings between the ribs. The open-ended circumferential slot allows soundwaves from the upper chamber to pass downward along the outside of the lower section to the ambient air surrounding the hanging speaker assembly.

The lower section includes an outer wall and a lower structure. The lower section extends at least partially into the outer shell of the upper section.

The outer wall forms a primary chamber with the low range speaker being positioned in an upper end thereof. The outer wall also forms an inner boundary of the open-ended circumferential slot.

The primary chamber receives the low range speaker therein. In one embodiment, the low range speaker is positioned near a top of the primary chamber.

The lower structure partitions off a lower end of the primary chamber to form a lower chamber below the primary chamber. The lower structure also includes a number of ports connecting the primary chamber to ambient air below the hanging speaker assembly 200.

The upper chamber, the openings extending between the ribs, and the open-ended circumferential slot direct low frequency soundwaves from the low range speaker downward and outward from the upper section. This allows the upper chamber and hence the speaker housing to be smaller while being more effective at projecting the low frequency soundwaves.

The ports in the lower structure allow soundwaves in the primary chamber to pass downward and out of the lower section. which enhances the reproduction of the lowest frequencies generated by the woofer or subwoofer thus improving sound quality and efficiency.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
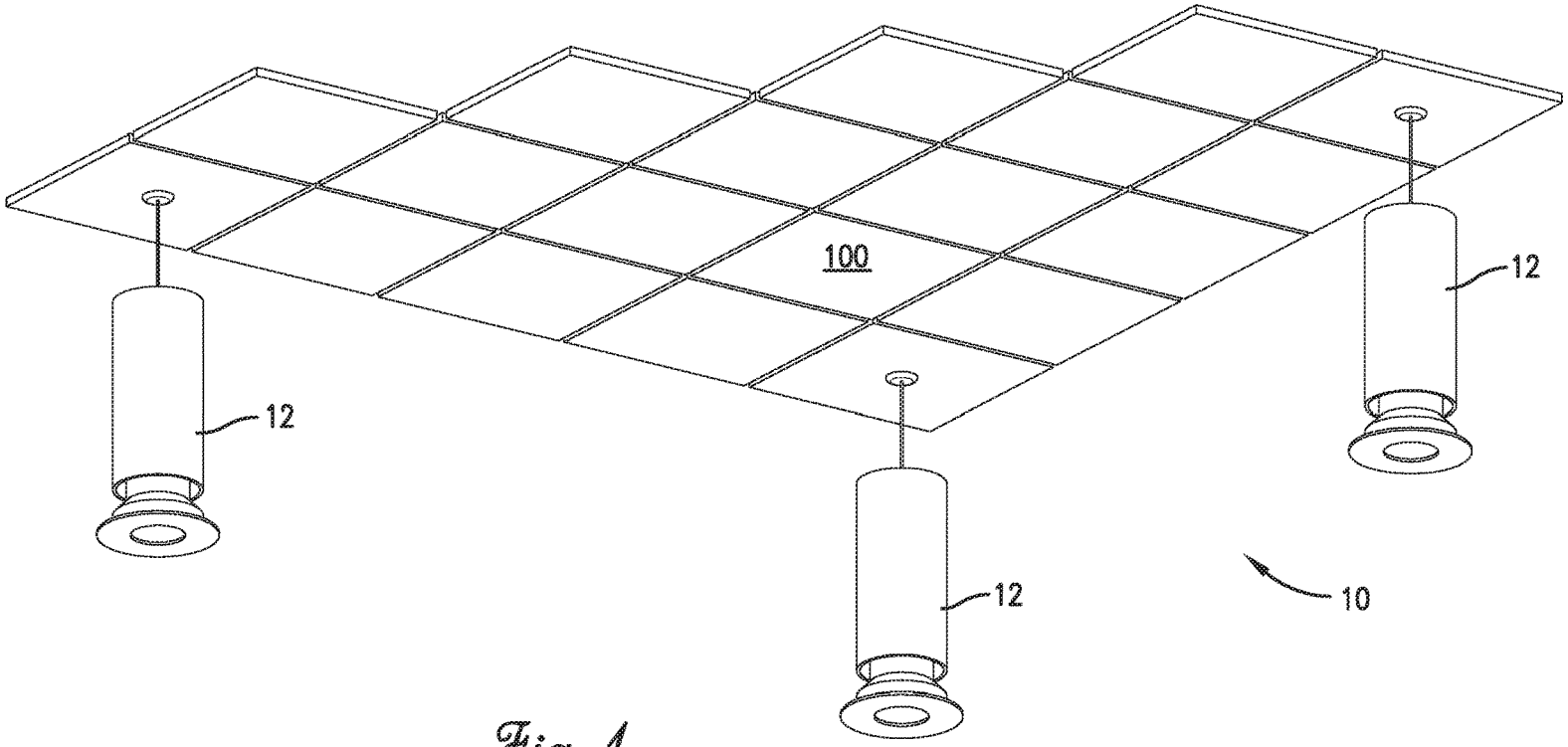
FIG. 1 is an environmental view of a speaker system constructed in accordance with an embodiment of the invention and including a number of speaker assemblies.
Figure 2:
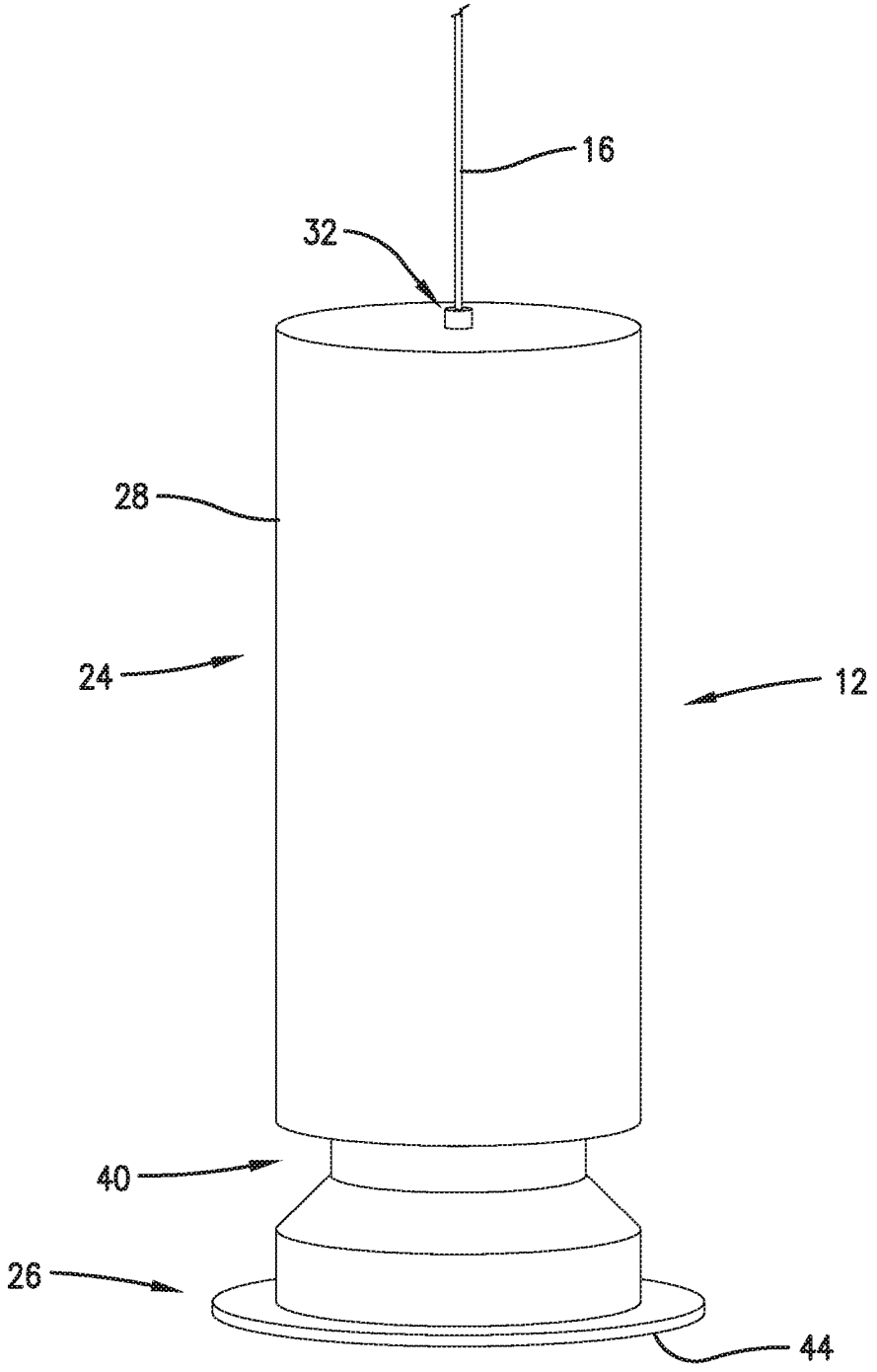
FIG. 2 is a perspective view of one speaker assembly of the speaker system shown in FIG. 1.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to the drawing figures, a hanging speaker system 10 constructed in accordance with an embodiment of the invention is illustrated. The hanging speaker system 10 broadly comprises a number of speaker assemblies 12 configured to be spaced apart from each other and hung from a ceiling 100 or other elevated structure to form a listening area. The speaker assemblies 12 may be communicatively connected to a sound system 102 such as an audio receiver, radio tuner, amplifier, mixer, computer, mobile computing device, portable music player, or any other suitable audio-capable electronic device via wires or wireless communication technology such as an internet connection, Bluetooth connection, radio frequency connection, cellular network, near field communication connection, or any other suitable wireless connection.

Embodiments of the speaker assemblies 12 will now be described in more detail. The speaker assemblies 12 each broadly comprise a speaker housing 14, a hanging component 16, an input circuit 18, a low range speaker 20, and a higher-range speaker 22.

Figure 3:
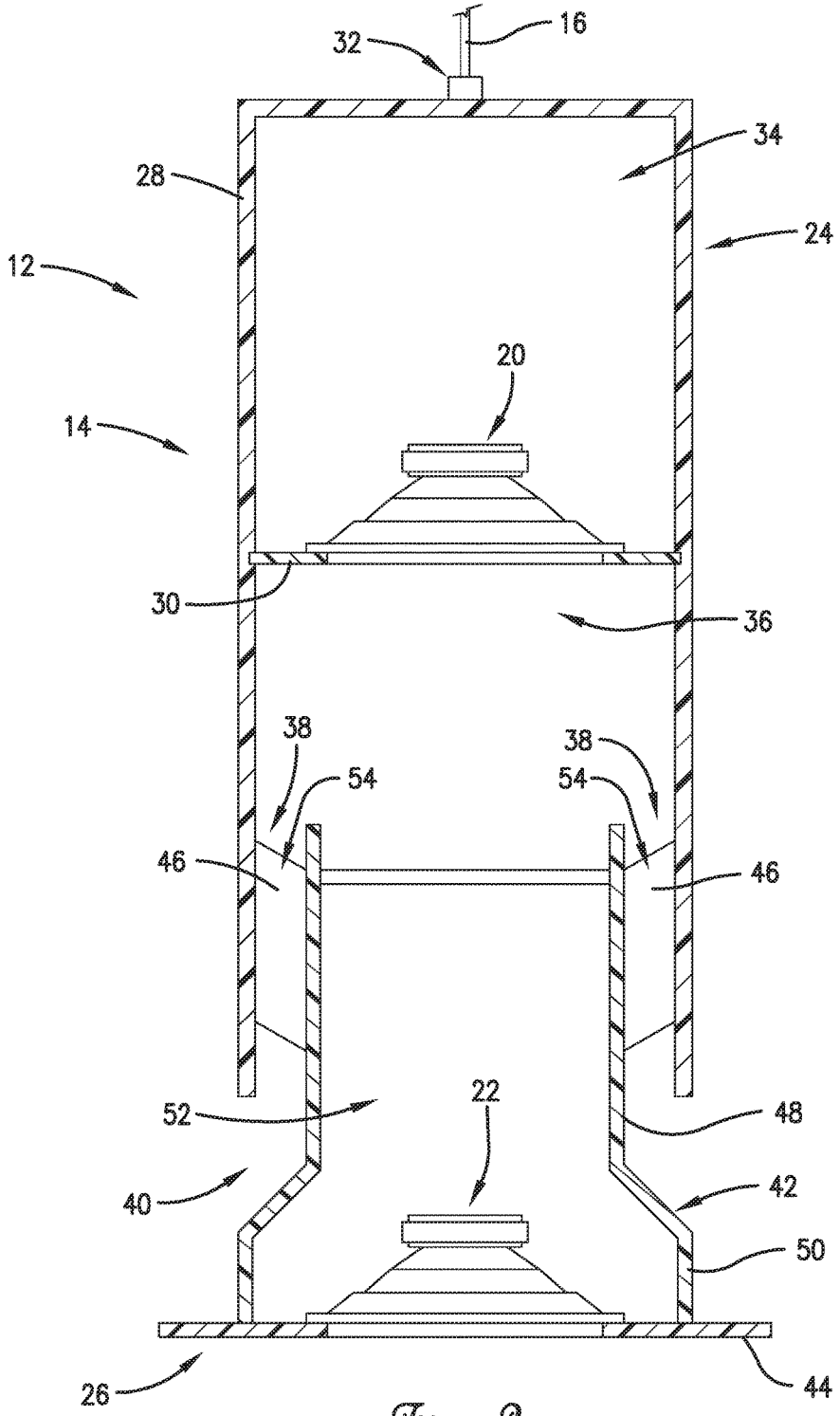
FIG. 3 is a cutaway elevation view of the speaker assembly of FIG. 2.
Figure 4:
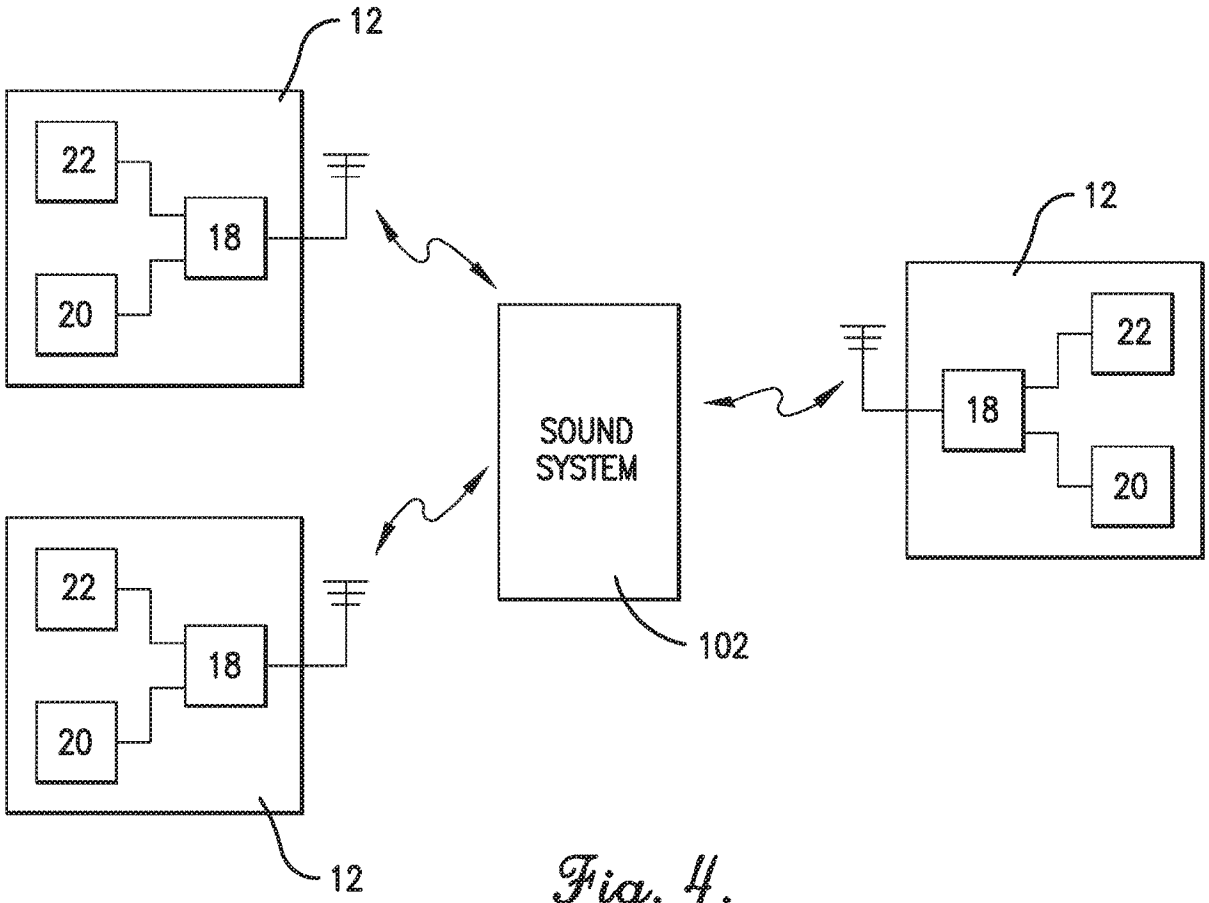
FIG. 4 is a schematic diagram of the speaker system of FIG. 1 in wireless communication with a sound system in accordance with another embodiment of the invention.
Figure 5:
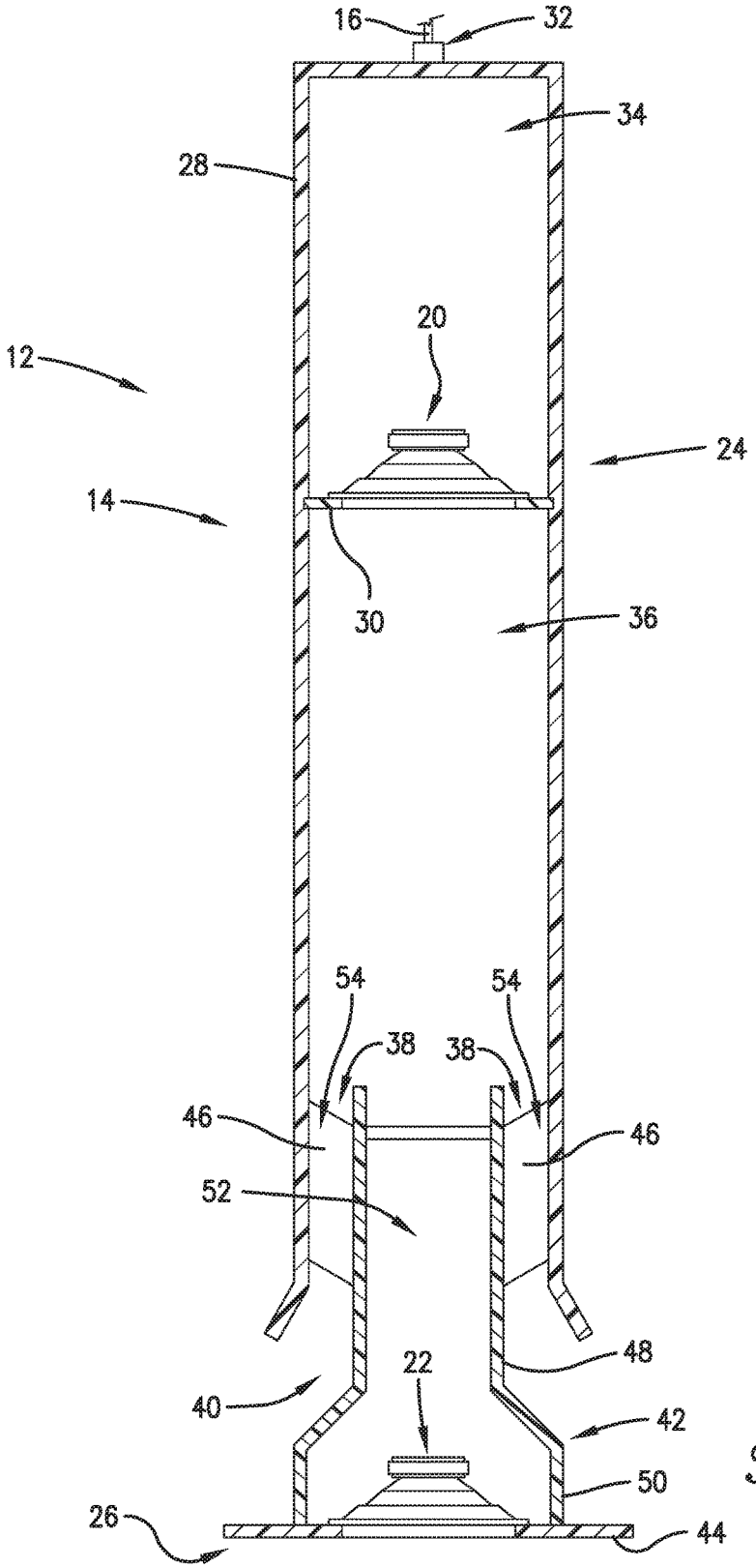
FIG. 5 is a cutaway elevation view of a speaker assembly constructed in accordance with another embodiment of the invention.

The speaker housing 14 protects the input circuit 18 and speakers 20, 22 from the environment and broadly comprises an upper section 24 and a lower section 26. In one embodiment, the speaker housing 14 may have an outer diameter of between five inches and twelve inches (not including the baffle described below) and a height of between approximately twenty inches and approximately forty inches. In one embodiment, the speaker housing 14 has an outer diameter of approximately ten inches and a height of approximately twenty-seven inches (FIG. 3). In another embodiment, the speaker housing 26 has an outer diameter of approximately six inches and a height of approximately thirty-seven inches (FIG. 5). The small diameter of the speaker housing 14 allows the speaker assembly 12 to be less conspicuous and may allow the speaker assembly 12 to be positioned in narrow spaces.

The upper section 24 encloses the low range speaker 20 and broadly comprises an outer wall 28, a divider 30, and a connector 32. The outer wall 28 defines an upper chamber 34 and a lower chamber 36. The outer wall 28 may have a thickness of between approximately one eighth of an inch and approximately three fourths of an inch. In one embodiment, a lower end of the outer wall 28 may be flared radially outward slightly (FIG. 5), the purpose of which will be described below. The outer wall 28 may have an outer diameter of between approximately five inches and approximately twelve inches. In one embodiment, the outer wall 28 has an outer diameter of approximately ten inches (FIG. 3). In another embodiment, the outer wall 28 has an outer diameter of approximately six inches (FIG. 5). The upper section 24 may be formed of PVC or other plastic, metal, or any other suitable material and may be waterproof and/or corrosion resistant.

The upper chamber 34 retains the low-range speaker 20 therein and may be acoustically shaped for projecting low frequency soundwaves generated by the low-range speaker 20 downwards and/or outwards. To that end, the outer wall 28 may be cylindrical, orthogonal, spherical, or any other suitable shape. The upper chamber 34 may also have any suitable size for optimizing the reproduction of desired low frequency soundwaves therefrom.

The lower chamber 36 encircles the lower section 26 and allows low frequency soundwaves generated by the low range speaker 20 to pass out of the speaker housing 14 via a lower port channel 38 and a lower port exit 40. The lower chamber 36 may be acoustically shaped for projecting low frequency soundwaves generated by the low range speaker 20 downwards through the lower port channel 38 and outwards through the lower port exit 40. To that end, the outer wall 28 may be cylindrical, orthogonal, spherical, or any other suitable shape. The lower chamber 36 may also have any suitable size for optimizing the projection of desired low frequency soundwaves therefrom.

The divider 30 extends horizontally in the upper section 24 and partitions the upper section 24 into the upper chamber 34 and the lower chamber 36. The divider 30 also supports the low-range speaker 20 such that the low-range speaker 20 is spaced from a top of the upper section 24. The divider 30 may be spaced from the top of the upper section 24 between approximately six inches and approximately fifteen inches and spaced from a top of the lower section 26 between approximately three inches and approximately fifteen inches. In one embodiment, the divider 30 is spaced approximately six inches from the top of the upper section 24 and spaced approximately seven inches from the top of the lower section 26. That is, the divider 30 may be positioned any suitable height below the top of the upper section 24 and above the top of the lower section 26 for optimizing the reproduction of desired low frequency soundwaves from the upper chamber 34 and lower chamber 36.

The connector 32 secures the hanging component 16 to the speaker housing 14 and may be positioned near a middle of the top of the upper section 24 so that the speaker assembly 12 is balanced and oriented vertically upright when hanging from the ceiling 100. The connector 32 may be integrally formed into the outer wall 28 of the upper section 24 such as a molded connection boss. The connector 32 may be an anchor, a hook, a fastener, or any other connecting feature.

The lower section 26 houses the higher-range speaker 22 and broadly comprises an outer wall 42, a baffle 44, and a plurality of vanes 46. The outer wall 42 includes an upper portion 48 and a lower portion 50 and forms an inner chamber 52. The lower section 26 and the outer wall 28 cooperatively form the lower port exit 40.

The upper portion 48 may be nested in the lower chamber 36 of the upper section 24 and thus may have a smaller outer diameter than an inner diameter of the outer wall 28. In some embodiments, the upper portion 48 may have a smaller outer diameter than an outer diameter of the lower portion 50. The upper portion 48 may extend upwards a selected vertical length so as to effect a desired length of the lower port channel 38. This optimizes low frequency output. To that end, if a cross section area of the lower port channel 38 and/or the lower port exit 40 is increased, the length of the lower port channel 38 should be increased. Likewise, if the cross section area of the lower port channel 38 and/or the lower port exit 40 is decreased, the length of the lower port channel 38 should be decreased. Meanwhile, decreasing the cross section area of the lower port exit 40 increases air velocity therethrough, which may cause port noise. Thus, the lower end of the outer wall 28 of the upper section 24 near the lower port exit 40 may be flared radially outward slightly (FIG. 5) so as to increase the cross section area of the lower port exit 40 and thereby reduce port noise. A longer flare provides more port noise mitigation.

The lower portion 50 may have an outer diameter substantially equal to the outer diameter of the outer wall 28 so that the lower portion 50 and the outer wall 28 appear essentially as vertical extensions of each other separated by the lower port exit 40. That is, the lower portion 50 may have a diameter of between approximately five inches and approximately twelve inches. In one embodiment, the lower portion 50 has an outer diameter of approximately ten inches (FIG. 3). In another embodiment, the lower portion 50 has an outer diameter of approximately six inches (FIG. 5). Alternatively, the lower portion 50 may have a diameter smaller or greater than the diameter of the outer wall 28.

The inner chamber 52 encloses the higher range speaker 26 therein. To that end, the inner chamber 52 may be cylindrical, orthogonal, spherical, bell-shaped, or any other suitable shape.

The baffle 44 at least partially encloses the inner chamber 52 of the lower section 26 and may extend radially beyond the lower portion 50. That is, the baffle 44 may have a diameter greater than the diameter of the lower portion 50. The baffle 44 may be sound permeable or may have a number of openings for allowing higher frequency soundwaves from the higher-range speaker 22 to pass out of the inner chamber 52. The baffle 44 concentrates higher frequency soundwaves below the speaker assembly 12. The baffle 44 may be a cover, a plate, or any other suitable enclosing structure.

The vanes 46 extend radially outward from the upper portion 48 of the outer wall 42 of the lower section 26 to the outer wall 28 of the upper section so as to connect the lower section 26 to the upper section 24. While the vanes 46 are described herein as being part of the lower section 26 and configured to be connected to the upper section 24, the vanes 46 may alternatively be part of the upper section 24 and configured to be connected to the lower section 26. The vanes 46 also divide the lower port channel 38 into a plurality of radial spaces 54. The radial spaces 54 are vertically extending pathways through which low frequency soundwaves from the low-range speaker 20 may pass from the lower chamber 36 to the lower port exit 40. Each radial space 54 may be bounded by part of the upper portion 48, adjacent vanes, and part of the outer wall 28 of the upper section 24.

The hanging component 16 suspends the speaker assembly 12 from the ceiling 100 or other elevated structure. To that end, the hanging component 16 may be secured to an anchor or other mounting feature of the ceiling 100 near its upper end and secured to the connector 32 at its lower end. The hanging component 16 may support or house electrical or electronic wiring connected between the input circuit 18 and the sound system 102 and/or a power source. The hanging component 16 may be a cable, a chain, a wire, a rope, a rigid member, or any other suitable structure. Alternatively, the speaker housing 14 may be mounted directly to the ceiling 100 or other elevated structure.

The input circuit 18 receives audio signals from the sound system 102 and actively or passively sends the audio signals to the speakers 20, 22. The input circuit 18 may include an antenna, data bus, data port, or any other suitable communication component, an amplifier, a mixer, or any other suitable sound manipulation component. The input circuit 16 may be positioned in the upper section 24, the lower section 26, or any other location for improving signal reception.

The low range speaker 20 generates low frequency soundwaves and may be positioned in or mounted to the divider 30. The low range speaker 20 may be aimed upwards or downwards for projecting the low frequency soundwaves through the lower port channel 38 (via the radial spaces 54) and out the lower port exit 40. The low range speaker 20 may be a woofer, subwoofer, bass speaker, or other low-range speaker.

The higher-range speaker 22 generates higher frequency soundwaves and may be positioned in or mounted to the baffle 44. The higher-range speaker 22 is aimed downwards for projecting higher frequencies. The higher-range speaker 22 may be a full range speaker, a woofer with a tweeter, a woofer with a midrange and tweeter, or any other similar speaker or combination of speakers.

Use of the above-described speaker system 10 will now be described in more detail. First, the speaker assemblies 12 may be spaced apart from each other throughout the listening area such that low frequency soundwaves and higher frequency soundwaves can be received from at least one of the speaker assemblies 12 for most and/or key regions of the listening area. In this way, soundwaves of a particular crossover frequency from a low-range speaker located at a given position and soundwaves of the same crossover frequency from a higher-range speaker located at the same position will not form acoustically muted regions.

The speaker assemblies 12 may be suspended from the ceiling 100 or another elevated structure via the hanging elements 16 for providing audio to a room, an indoor or outdoor shopping space, a pavilion, or any other suitable area. The speaker assemblies 12 can be concealed or inconspicuously positioned so as to not draw attention to them. The cylindrical shape of the speaker housings 14 further diverts attention from the speaker assemblies 12.

The upper portion 48 may extend upwards a selected vertical length so as to effect a desired length of the lower port channel 38. This may allow acoustics of the low frequency soundwaves to have a desired effect and may reduce port noise.

Figure 6:
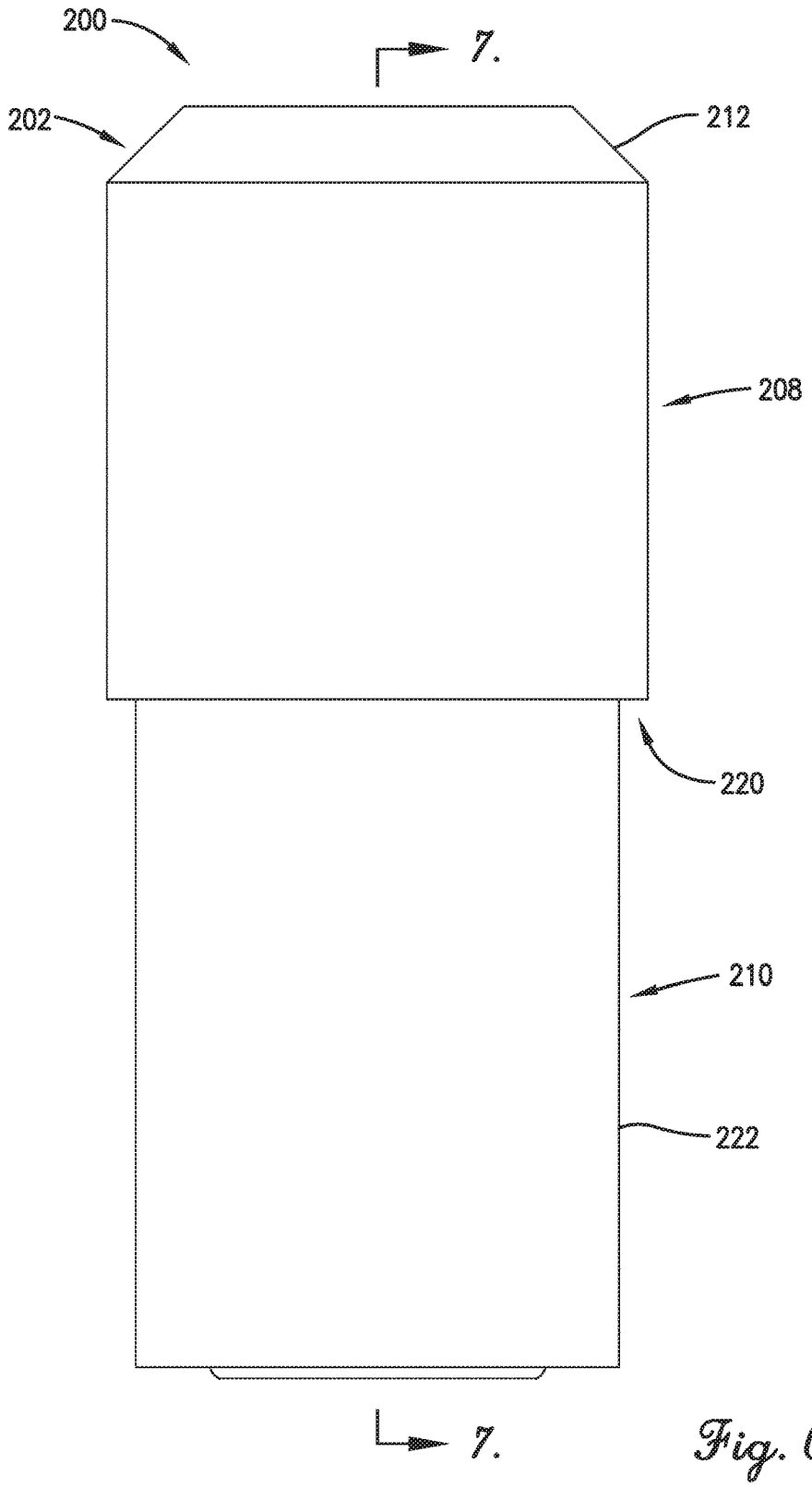
FIG. 6 is an elevation view of a speaker assembly constructed in accordance with another embodiment of the invention.
Figure 7:
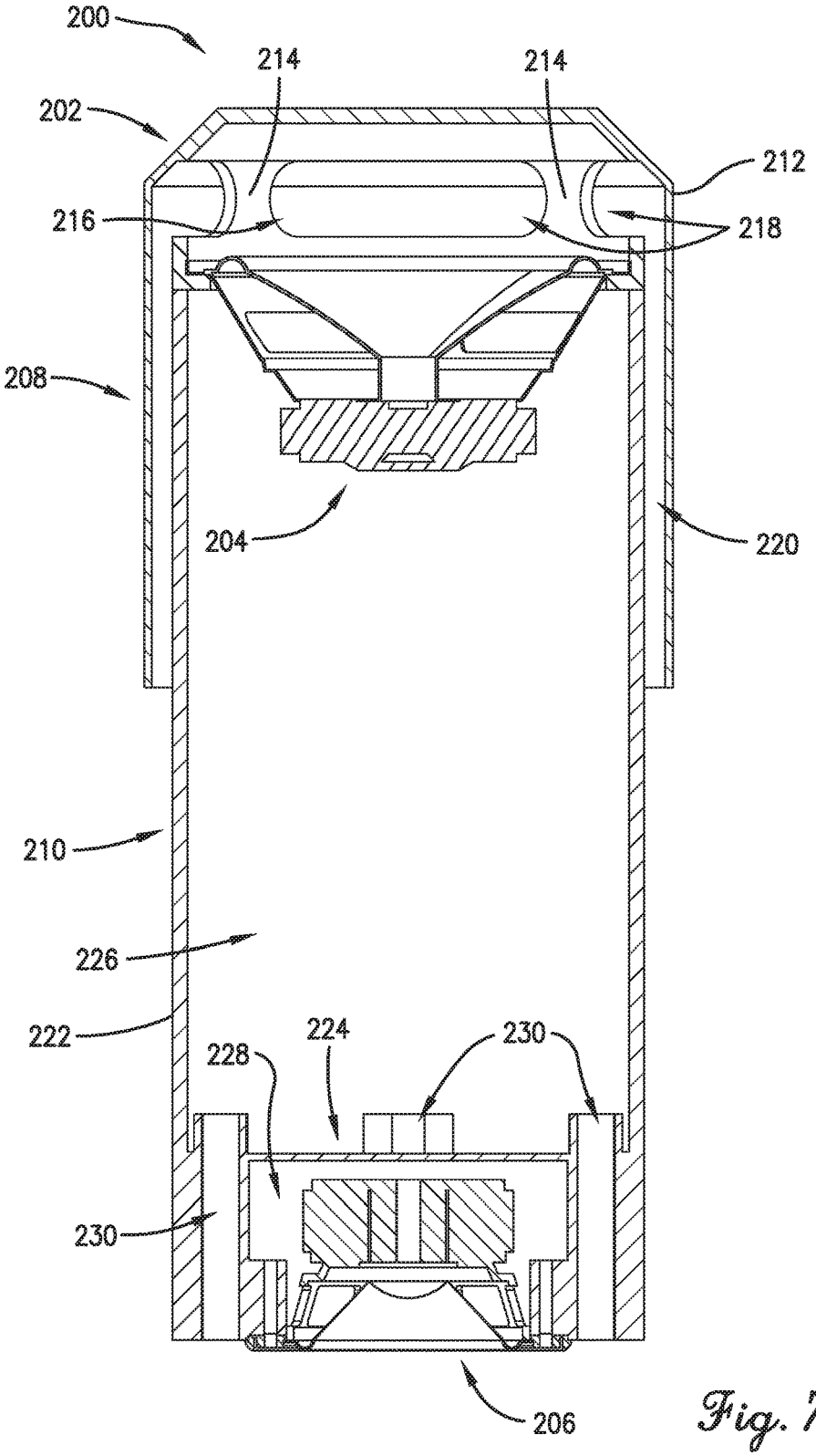
FIG. 7 is a cutaway elevation view of the speaker assembly of FIG. 6.
Figure 8:
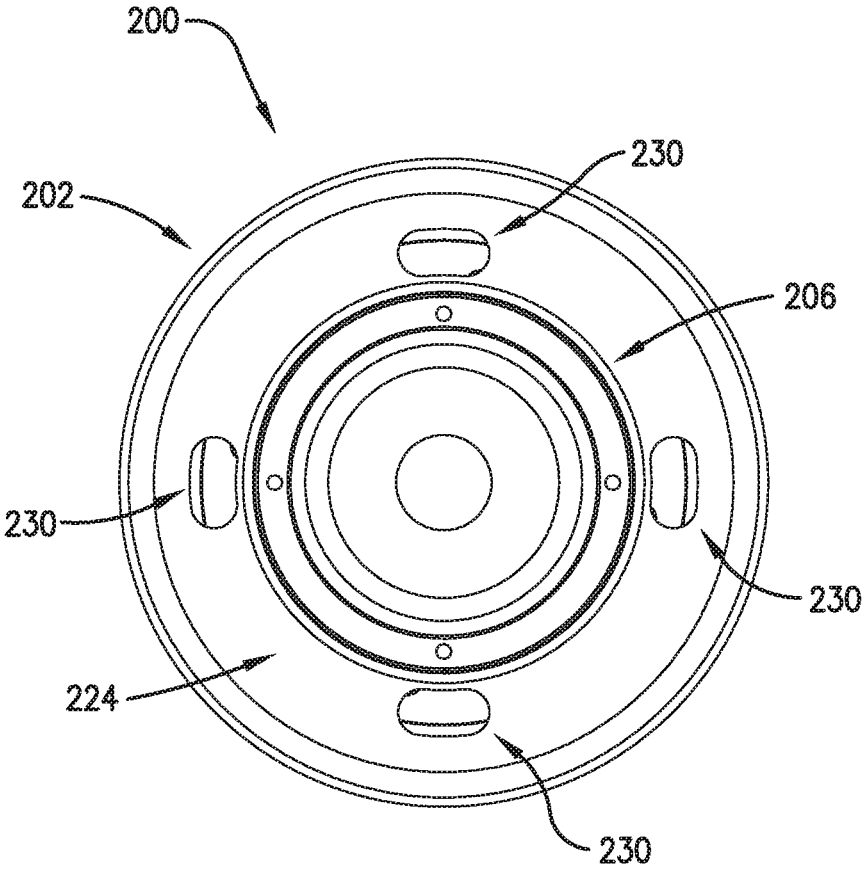
FIG. 8 is a bottom plan view of the speaker assembly of FIG. 6.

Turning to FIGS. 6-8, a hanging speaker assembly 200 constructed in accordance with another embodiment of the invention is illustrated. The hanging speaker assembly 200 broadly comprises a speaker housing 202, an input circuit, a low range speaker 204, and a higher range speaker 206.

The speaker housing 202 broadly comprises an upper section 208 and a lower section 210 for protecting the input circuit and speakers 204, 206 from the surrounding environment. In one embodiment, the speaker housing 202 may have an outer diameter of between five inches and twelve inches and approximately forty inches. In another embodiment, the speaker housing 202 has an outer diameter of approximately ten inches and a height of approximately twenty-seven inches.

The upper section 208 includes an outer shell 212 and a plurality of ribs 214. The outer shell 212 covers a top end of the lower section 210 and encircles an upper portion of the lower section 210. The outer shell 212 is vertically spaced from the top end of the lower section 210 so as to form an upper chamber 216 and is radially spaced from the lower section 210 so as to form an open-ended circumferential slot 220. The outer shell 212 may be angled, tapered, chamfered, radiused or filleted near an upper perimeter thereof.

The upper chamber 216 redirects soundwaves from the low range speaker 204 outward to the open-ended circumferential slot 220 via openings 218 between the ribs 214. The open-ended circumferential slot 220 allows soundwaves from the upper chamber 216 to pass downward along the outside of the lower section 210 to the ambient air around the hanging speaker assembly 200. The angled, tapered, chamfered, radiused or filleted shape of the outer shell 212 may improve soundwave redirection from the upper chamber 216 to the open-ended circumferential slot 220.

The ribs 214 connect the upper section 208 to the lower section 210 and space the upper section 208 above the top end of the lower section 210. The ribs 214 are also spaced from each other so as to form the openings 218 therebetween. The openings 218 allow soundwaves to pass from the upper chamber 216 to the open-ended circumferential slot 220. In one embodiment, the ribs 214 include four equally-spaced ribs.

The lower section 210 includes an outer wall 222 and a lower structure 224. The lower section 210 extends at least partially into the outer shell 212 of the upper section 208 and may be substantially cylindrical.

The outer wall 222 forms a primary chamber 226 with the low range speaker being positioned in an upper end thereof. The outer wall 222 also forms an inner boundary of the open-ended circumferential slot.

The lower structure 224 partitions off a lower end of the primary chamber 226 to form a lower chamber 228 below the primary chamber 226. The lower chamber 228 may be sealed or may be ported. The lower structure 224 also includes a number of ports 230 connecting the primary chamber 226 to ambient air below the hanging speaker assembly 200. In one embodiment, the ports 230 include four ports evenly spaced from each other circumferentially around the lower chamber 228.

The input circuit receives audio signals from a sound system and actively or passively sends the audio signals to the speakers 204, 206. The input circuit may be substantially similar to the input circuit described above. That is, the input circuit may include an antenna, data bus, data port, or any other suitable communication component, an amplifier, a mixer, or any other suitable sound manipulation component. The input circuit may be positioned in the upper section 208, the lower section 210, or any other location for improving signal reception.

The low range speaker 204 generates low frequency soundwaves and may be positioned near a top end of the primary chamber 226. The low range speaker 204 may be attached to mounting structure of the upper section 208 or lower section 210 and may face upward to project soundwaves into the upper chamber 216. The low range speaker 204 may be a woofer, subwoofer, bass speaker, or other low-range speaker.

The higher range speaker 206 generates higher frequency soundwaves instead of or in addition to low frequency soundwaves and may be positioned in the lower chamber 228. The higher range speaker 206 may face downward for projecting soundwaves to the ambient air below the hanging speaker assembly 200. The higher range speaker 206 may be a full range speaker, a woofer with a tweeter, a woofer with a midrange and tweeter, or any other similar speaker or combination of speakers.

Use of the above-described hanging speaker assembly 200 will now be described in more detail. First, the hanging speaker assembly 200 may be spaced apart from other hanging speaker assemblies throughout a listening area such that low frequency soundwaves and higher frequency soundwaves can be received from at least one hanging speaker assembly for most and/or key regions of the listening area. In this way, soundwaves of a particular crossover frequency from a low range speaker locate at a given position and soundwaves of the same crossover frequency from a full range speaker (or a higher-range speaker) located at the same position will not form acoustically muted regions.

The hanging speaker assembly 200 may be suspended from a ceiling or another elevated structure via hanging elements for providing audio to a room, an indoor or outdoor shopping space, a pavilion, or any other suitable area. The hanging speaker assembly 200 can be concealed or inconspicuously positioned so as to not draw attention to it. The cylindrical shape of the speaker housing 202 further diverts attention from the hanging speaker assembly 200.

The upper chamber 216, the openings 218 extending between the ribs 214, and the open-ended circumferential slot 220 direct low frequency soundwaves from the low range speaker downward and outward from the upper section 208. This allows the upper chamber 216 and hence the speaker housing 202 to be smaller while being more effective at projecting the low frequency soundwaves.

The ports 230 in the lower structure 224 allow soundwaves in the primary chamber to pass downward and out of the lower section 210, which enhances the reproduction of the lowest frequencies generated by the woofer or subwoofer, thus improving sound quality and efficiency.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A speaker assembly comprising:

a speaker housing including:

an upper section having an outer shell and defining an upper chamber;

a lower section at least partially extending into the upper section, the lower section having an outer wall defining a primary chamber, the outer wall and the outer shell of the upper section defining an open-ended circumferential slot therebetween such that the open-ended circumferential slot at least partially encircles the outer wall;

an input circuit for receiving audio signals from an audio source;

a low range speaker positioned in the primary chamber of the lower section and coupled with the input circuit for generating low frequency soundwaves and projecting the low frequency soundwaves into the upper chamber of the upper section so that the low frequency soundwaves pass downward from the upper chamber through the open-ended circumferential slot to ambient air; and a higher range speaker positioned below the low range speaker and coupled with the input circuit for generating higher frequency soundwaves, the speaker assembly being configured to be suspended from an elevated structure and configured to be spaced from other speaker assemblies such that each speaker assembly produces low frequency soundwaves and higher frequency soundwaves so as to reduce out-of-phase crossover frequency wave cancellation effects within a listening area of the speaker assembly.

2. The speaker assembly of claim 1, the upper section further including a plurality of ribs spaced apart from each other and forming openings therebetween, the openings connecting the upper chamber to the open-ended circumferential slot.

3. The speaker assembly of claim 2, wherein the ribs include four ribs equally spaced from each other forming four openings equally spaced from each other.

4. The speaker assembly of claim 2, wherein the ribs connect the outer shell of the upper section to the lower section.

5. The speaker assembly of claim 1, wherein the low range speaker is positioned near a top of the primary chamber.

6. The speaker assembly of claim 5, wherein the low range speaker faces upward to the upper chamber.

7. The speaker assembly of claim 1, wherein the lower section further includes a lower structure defining a lower chamber, the higher range speaker being positioned in the lower chamber.

8. The speaker assembly of claim 7, wherein the lower chamber is a sealed chamber.

9. The speaker assembly of claim 7, wherein the lower structure includes a plurality of ports connecting the primary chamber to ambient air.

10. The speaker assembly of claim 9, wherein the ports extend vertically downward from the primary chamber to a bottom of the lower section.

11. The speaker assembly of claim 9, wherein the ports include four ports equally spaced from each other.

12. The speaker assembly of claim 9, wherein the ports are spaced radially from the lower chamber.

13. The speaker assembly of claim 1, wherein the outer shell is chamfered near an upper perimeter thereof.

14. A speaker assembly comprising:

a speaker housing including:

an upper section having a cylindrical outer shell and defining an upper chamber;

a lower section at least partially extending into the upper section, the lower section having a cylindrical outer wall defining a primary chamber below the upper chamber, the outer wall and the outer shell of the upper section defining an open-ended circumferential slot therebetween such that the open-ended circumferential slot at least partially encircles the outer wall;

an input circuit for receiving audio signals from an audio source;

a low range speaker positioned near a top of the primary chamber of the lower section and coupled with the input circuit for generating low frequency soundwaves and projecting the low frequency soundwaves into the upper chamber of the upper section so that the low frequency soundwaves pass downward from the upper chamber through the open-ended circumferential slot to ambient air; and a higher range speaker positioned below the low range speaker and coupled with the input circuit for generating higher frequency soundwaves, the speaker assembly being configured to be suspended from an elevated structure and configured to be spaced from other speaker assemblies such that each speaker assembly produces low frequency soundwaves and higher frequency soundwaves so as to reduce out-of-phase crossover frequency wave cancellation effects within a listening area of the speaker assembly.

15. The speaker assembly of claim 14, the upper section further including a plurality of ribs spaced apart from each other and forming openings therebetween, the openings connecting the upper chamber to the open-ended circumferential slot.

16. The speaker assembly of claim 15, wherein the lower section further includes a lower structure defining a lower chamber below the primary chamber, the higher range speaker being positioned in the lower chamber.

17. The speaker assembly of claim 16, wherein the lower structure includes a plurality of ports connecting the primary chamber to ambient air.

18. The speaker assembly of claim 17, wherein the ports extend vertically downward from the primary chamber to a bottom of the lower section.

19. The speaker assembly of claim 17, wherein the ports are spaced radially from the lower chamber.

20. A speaker assembly comprising:

a speaker housing including:

an upper section having a cylindrical outer shell and four ribs equally spaced apart from each other and forming four openings equally spaced apart from each other, the upper section defining an upper chamber;

a lower section at least partially extending into the upper section, the lower section having a cylindrical outer wall and a lower structure, the cylindrical outer wall defining a primary chamber below the upper chamber, the cylindrical outer wall and the cylindrical outer shell of the upper section defining an open-ended circumferential slot therebetween such that the open-ended circumferential slot at least partially encircles the outer wall, the openings connecting the upper chamber to the open-ended circumferential slot, the lower structure defining a lower chamber and four ports connecting the primary chamber to ambient air;

an input circuit for receiving audio signals from an audio source;

a low range speaker positioned near a top of the primary chamber of the lower section and facing upward to the upper chamber, the low range speaker being coupled with the input circuit for generating low frequency soundwaves and projecting the low frequency soundwaves into the upper chamber so that the low frequency soundwaves pass downward from the upper chamber through the open-ended circumferential slot to ambient air; and a higher range speaker positioned in the lower chamber and coupled with the input circuit for generating higher frequency soundwaves, the speaker assembly being configured to be suspended from an elevated structure and configured to be spaced from other speaker assemblies such that each speaker assembly produces low frequency soundwaves and higher frequency soundwaves so as to reduce out-of-phase crossover frequency wave cancellation effects within a listening area of the speaker assembly.

* * * * *